US005692795A

United States Patent [19]

Mininger

[11] Patent Number: 5,692,795

[45] Date of Patent: Dec. 2, 1997

[54] TAILGATE TENT

[76] Inventor: Nathan Mininger, 5918 Salisbury Ct., Merced, Calif. 95340

[21] Appl. No.: 767,146

[22] Filed: Dec. 16, 1996

[51] Int. Cl.[6] ..... B60P 3/32

[52] U.S. Cl. ..... 296/164; 135/88.13; 52/217; 296/159

[58] Field of Search ..... 296/164, 165, 296/173, 159, 24.1; 135/88.1, 87, 88.13, 88.15; 52/2.11, 2.17, 2.18, 2.24

[56] References Cited

U.S. PATENT DOCUMENTS

| | | | |
|---|---|---|---|
| 2,910,994 | 11/1959 | Joy | 52/2.11 |
| 4,000,585 | 1/1977 | Denaro | 52/2.17 |
| 4,093,302 | 6/1978 | Adams | 296/156 |
| 4,296,960 | 10/1981 | Winchester | 135/88.13 X |
| 4,657,299 | 4/1987 | Mahan | 135/88.13 X |
| 5,419,607 | 5/1995 | Oliveira | 296/165 X |
| 5,487,400 | 1/1996 | Dawkins | 135/87 |

*Primary Examiner*—Joseph D. Pape

[57] ABSTRACT

A new Tailgate Tent for providing an inflatable tent formed to snugly fit within the bed of a pickup truck. The inventive device includes a plurality of elongated floor tubes secured parallel to one another, a plurality of wall tubes secured parallel to one another having a pair of wheel well cavities and secured to the opposite sides of the elongated floor tubes to form a U-shaped tube shape, a first wall and a second wall secured to the opposite ends of the U-shaped tube, and a zipper door within the first wall.

6 Claims, 3 Drawing Sheets

Fig. 1
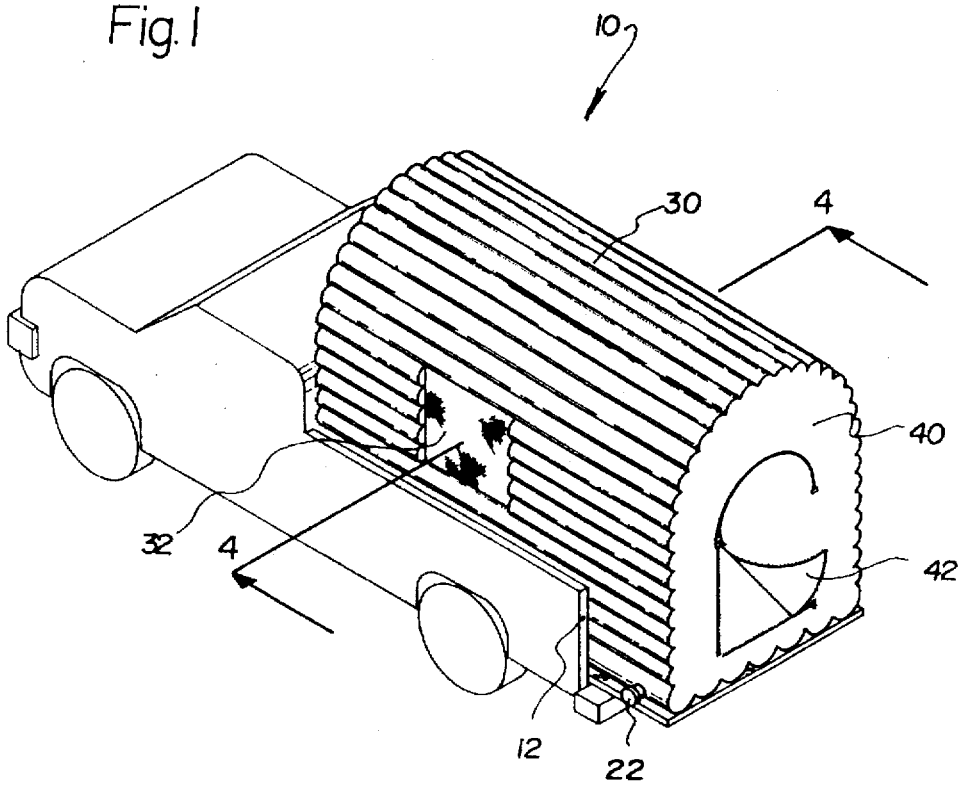
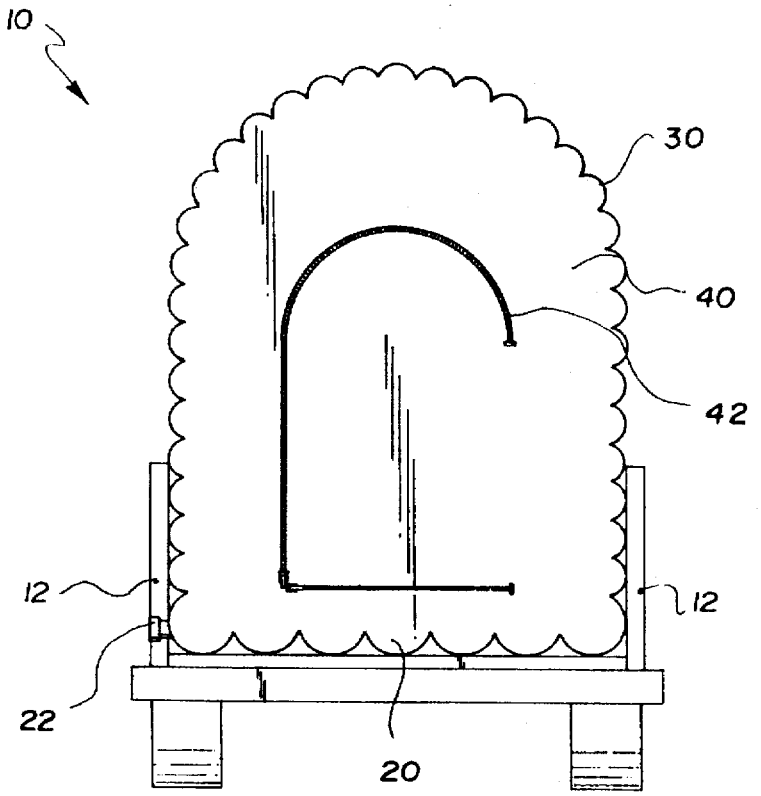
Fig. 2

TAILGATE TENT

BACKGROUND OF THE INVENTION

1. Field of the Invention

The present invention relates to Tent Devices and more particularly pertains to a new Tailgate Tent for providing an inflatable tent formed to snugly fit within the bed of a pickup truck.

2. Description of the Prior Art

The use of Tent Devices is known in the prior art. More specifically, Tent Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Tent Devices include U.S. Pat. No. 5,339,851; U.S. Pat. No. 4,819,389; U.S. Design Pat. No. 352,690; U.S. Design Pat. No. 337,979; U.S. Design Pat. No. 318,446; U.S. Pat. No. 4,652,040; U.S. Pat. No. 5,011, 216 and U.S. Design Pat. No. 302,720.

While these devices fulfill their respective, particular objectives and requirements, the aforementioned patents do not disclose a new Tailgate Tent. The inventive device includes a plurality of elongated floor tubes secured parallel to one another, a plurality of wall tubes secured parallel to one another having a pair of wheel well cavities and secured to the opposite sides of the elongated floor tubes to form a U-shaped tube shape, a first wall and a second wall secured to the opposite ends of the U-shaped tube, and a zipper door within the first wall.

In these respects, the Tailgate Tent according to the present invention substantially departs from the conventional concepts and designs of the prior art, and in so doing provides an apparatus primarily developed for the purpose of providing an inflatable tent formed to snugly fit within the bed of a pickup truck.

SUMMARY OF THE INVENTION

In view of the foregoing disadvantages inherent in the known types of Tent Devices now present in the prior art, the present invention provides a new Tailgate Tent construction wherein the same can be utilized for providing an inflatable tent formed to snugly fit within the bed of a pickup truck.

The general purpose of the present invention, which will be described subsequently in greater detail, is to provide a new Tailgate Tent apparatus and method which has many of the advantages of the Tent Devices mentioned heretofore and many novel features that result in a new Tailgate Tent which is not anticipated, rendered obvious, suggested, or even implied by any of the prior art Tent Devices, either alone or in any combination thereof.

To attain this, the present invention generally comprises a plurality of elongated floor tubes secured parallel to one another, a plurality of wall tubes secured parallel to one another having a pair of wheel well cavities and secured to the opposite sides of the elongated floor tubes to form a U-shaped tube shape, a first wall and a second wall secured to the opposite ends of the U-shaped tube, and a zipper door within the first wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Tailgate Tent apparatus and method which has many of the advantages of the Tent Devices mentioned heretofore and many novel features that result in a new Tailgate Tent which is not anticipated, rendered obvious, suggested, or even implied by any of the prior art Tent Devices, either alone or in any combination thereof.

It is another object of the present invention to provide a new Tailgate Tent which may be easily and efficiently manufactured and marketed.

It is a further object of the present invention to provide a new Tailgate Tent which is of a durable and reliable construction.

An even further object of the present invention is to provide a new Tailgate Tent which is susceptible of a low cost of manufacture with regard to both materials and labor, and which accordingly is then susceptible of low prices of sale to the consuming public, thereby making such Tailgate Tent economically available to the buying public.

Still yet another object of the present invention is to provide a new Tailgate Tent which provides in the apparatuses and methods of the prior art some of the advantages thereof, while simultaneously overcoming some of the disadvantages normally associated therewith.

Still another object of the present invention is to provide a new Tailgate Tent for providing an inflatable tent formed to snugly fit within the bed of a pickup truck.

Yet another object of the present invention is to provide a new Tailgate Tent which includes a plurality of elongated floor tubes secured parallel to one another, a plurality of wall tubes secured parallel to one another having a pair of wheel well cavities and secured to the opposite sides of the elongated floor tubes to form a U-shaped tube shape, a first wall and a second wall secured to the opposite ends of the U-shaped tube, and a zipper door within the first wall.

Still yet another object of the present invention is to provide a new Tailgate Tent that fits snugly into the bed of a pickup.

Even still another object of the present invention is to provide a new Tailgate Tent that can be deflated and easily stored in a carry bag to provide efficient storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an upper side perspective view of a new Tailgate Tent according to the present invention.

FIG. 2 is a rear view of the present invention snugly positioned within the bed of a pickup.

DESCRIPTION OF THE PREFERRED EMBODIMENT

Figure 3:
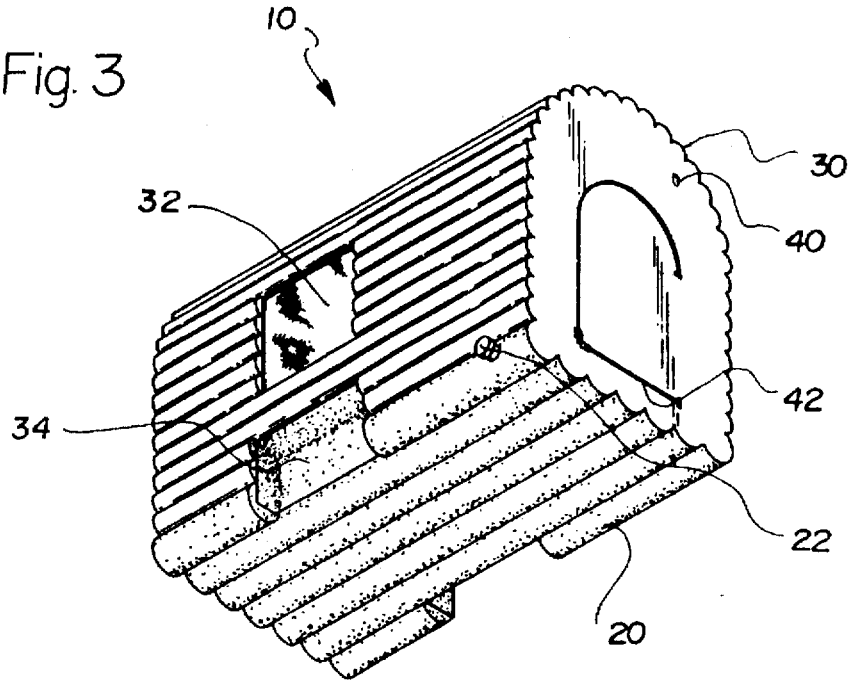
FIG. 3 is a lower perspective view of the present invention.

With reference now to the drawings, and in particular to FIGS. 1 through 7 thereof, a new Tailgate Tent embodying the principles and concepts of the present invention and generally designated by the reference numeral 10 will be described.

More specifically, it will be noted that the Tailgate Tent 10 comprises a plurality of elongated floor tubes 20 expandable when filled with air secured parallel to one another to the size of a pickup bed 12, a plurality of elongated wall tubes 30 expandable when filled with air secured parallel to one another and secured to each side of the elongated floor tubes 20 forming a U-shaped tube, a first wall 40 having a zipper door 42 secured at an end of the U-shaped tube, and a second wall 50 secured to the end of the U-shaped tube opposite of the first wall 40, thereby enclosing the U-shaped tube.

Figure 4:
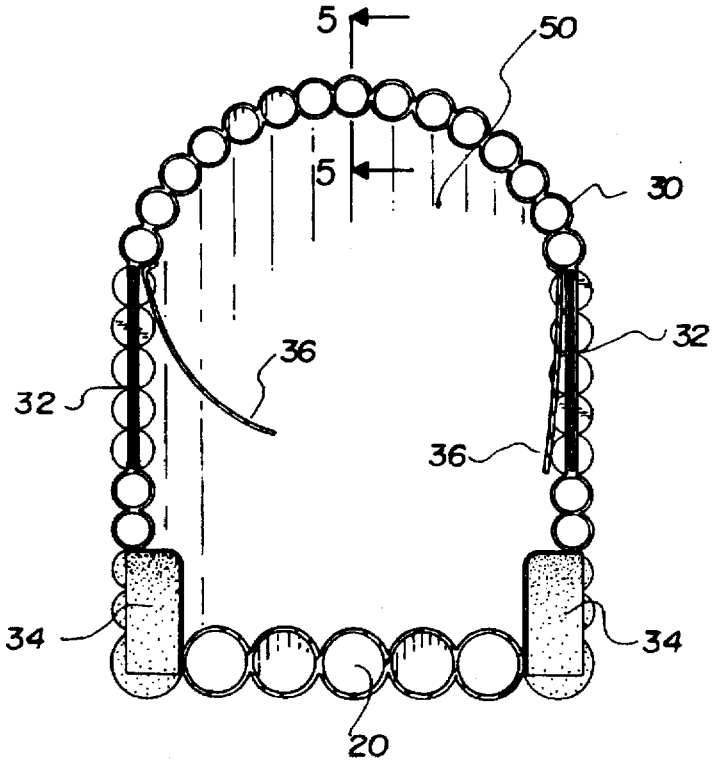
FIG. 4 is a cross sectional view taken along line 4—4 of FIG. 1.
Figure 5:
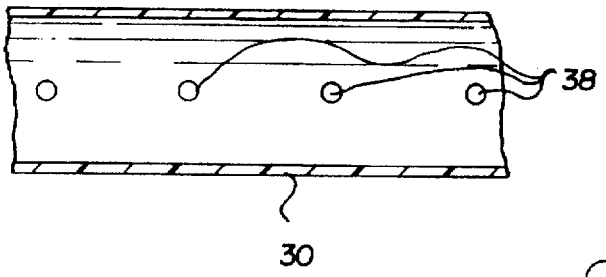
FIG. 5 is a cross sectional view taken along line 5—5 of FIG. 4.
Figure 6:
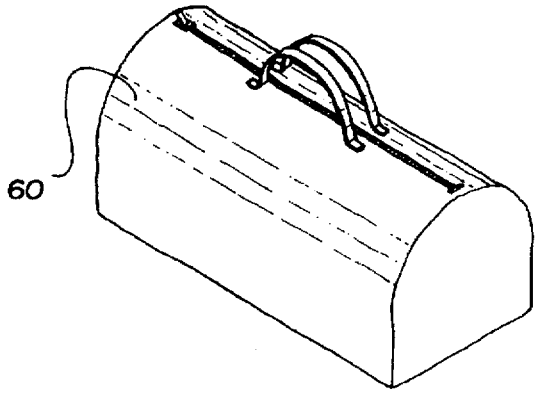
FIG. 6 is an upper perspective view of the storage bag.
Figure 7:
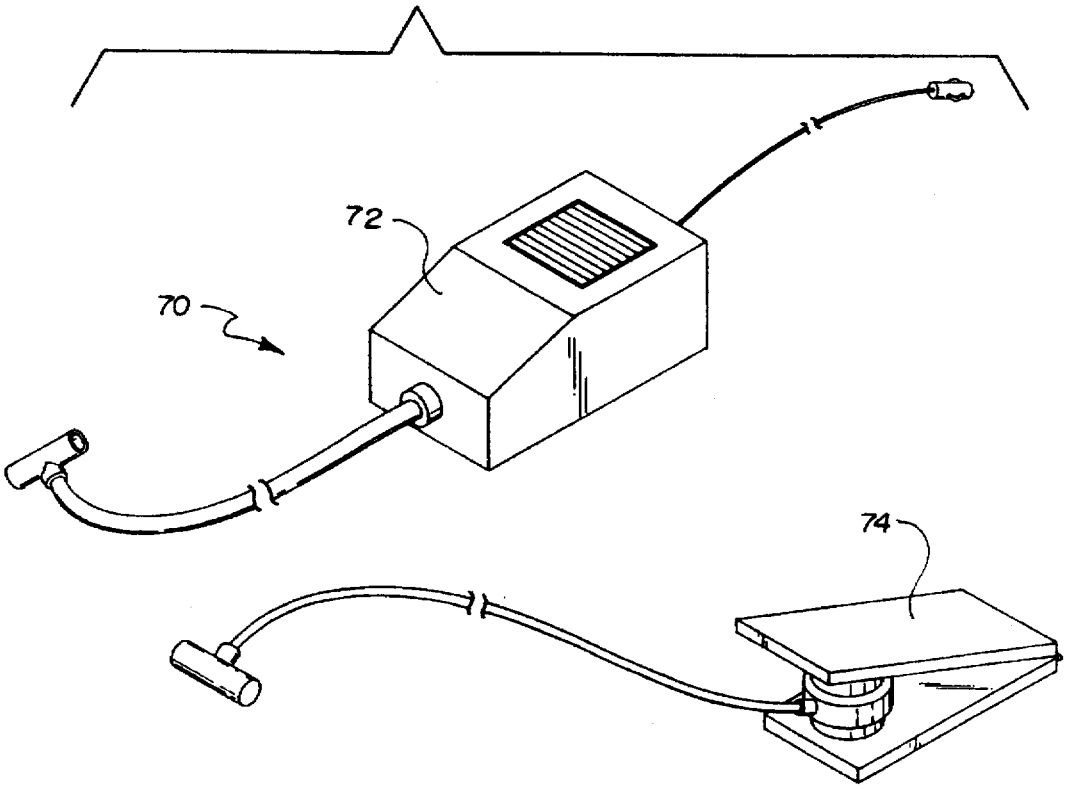
FIG. 7 is an upper perspective view of an electric pump and a foot pump.

As best illustrated in FIGS. 3 and 4, it can be shown that a pair of wheel well cavities 34 project into the concentric side portions of the elongated wall tubes 30, formed to the shape of the pickup's wheel wells. The elongated floor tubes 20 and the elongated wall tubes 30 have a plurality of pressure equalization apertures 38 into the juxtaposed wall portions to allow filling of the tent as disclosed in FIG. 5 of the drawings. As best shown in FIGS. 1 through 3, a fill nozzle 22 is secured within the elongated floor tubes 20 which receives an air nozzle from an electric pump 72 or a foot pump 74. As shown in FIG. 6 of the drawings, a storage bag 60 receives and stores the tailgate tent 10 when deflated. A window screen 32 is secured within the elongated wall tubes, and a shade flap 36 is pivotally secured above the window screen 32 to the interior portion of the elongated wall tubes 30.

In use, the user positions the present invention within the bed 12 of a pickup. The fill nozzle 22 is filled with air to expand the elongated floor tubes 20 and the elongated wall tubes 30 to snugly fit within the bed 12 of the pickup.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Tailgate Tent for removably placing in the cargo bed of a pickup truck, comprising:

a plurality of elongated floor tubes expandable when filled with air and secured together in a parallel relationship for resting on the floor of a pickup truck bed;

a plurality of elongated wall tubes expandable when filled with air and secured together in a parallel relationship to one another and being secured to each side of said elongated floor tubes such that said plurality of wall tubes form an inverted U-shaped tube including a roof when secured to sides of the floor tubes;

a first end wall secured at an end of said U-shaped tube and having a door opening with a zipper closure; and a second end wall secured to the end of said U-shaped tube opposite of said first wall, thereby enclosing said U-shaped tube.

2. The Tailgate Tent of claim 1, wherein said plurality of wall tubes include a pair of wheel well cavities for conforming to the shape of the wheel wells projecting from the pickup bed.

3. The Tailgate Tent of claim 1, wherein said elongated floor tubes and said elongated wall tubes include a plurality of pressure equalization passages between the interiors of the elongate tubes to allow fluid communication between the elongated tubes to permit filling of the tent.

4. The Tailgate Tent of claim 1, wherein a fill nozzle is secured to an elongated tube for receiving an air nozzle from an air pump.

5. The Tailgate Tent of claim 1 in combination with a storage bag for receiving and storing said tailgate tent when deflated.

6. The Tailgate Tent of claim 1, wherein a window screen is secured within an opening in said plurality of elongated wall tubes, and wherein a shade flap is pivotally secured above said opening in said elongated wall tubes to cover said opening.

* * * * *